United States Patent [19]

Anderson

[11] Patent Number: 5,011,364

[45] Date of Patent: Apr. 30, 1991

[54] PORTABLE ARTICLE HANDLING/SUPPORTING APPARATUS

[76] Inventor: John E. Anderson, 395 Blossom St., Fitchburg, Mass. 01420

[21] Appl. No.: 443,157

[22] Filed: Nov. 30, 1989

[51] Int. Cl.[5] ..... B66C 1/10

[52] U.S. Cl. ..... 414/694; 188/171; 254/124; 254/8 B

[58] Field of Search ..... 414/694, 546; 188/171, 188/29; 280/62; 212/244, 245, 254, 232, 237; 254/124, 8 B

[56] References Cited

U.S. PATENT DOCUMENTS

| | | | |
|---|---|---|---|
| 1,489,161 | 4/1924 | Schuchert | 212/260 X |
| 3,630,389 | 12/1971 | Schmidt | 414/4 |
| 3,811,576 | 5/1974 | Fagen | 212/261 X |
| 3,850,307 | 11/1974 | Motoda | 901/14 X |
| 4,090,625 | 5/1978 | Walters | 212/264 X |
| 4,132,292 | 1/1979 | Dufresne | 188/171 |
| 4,177,002 | 12/1979 | Motoda et al. | 901/14 X |
| 4,196,797 | 4/1980 | Taylor | 188/171 X |
| 4,209,166 | 6/1980 | DeRouen | 269/71 |
| 4,276,962 | 7/1981 | Aulik | 188/29 X |
| 4,515,333 | 5/1985 | Pugh et al. | 248/122 |
| 4,517,632 | 5/1985 | Roos | 188/171 X |
| 4,548,373 | 10/1985 | Komura | 188/171 X |
| 4,564,179 | 1/1986 | Hollingsworth | 269/71 |
| 4,570,758 | 2/1986 | Hendricks | 188/171 X |
| 4,750,588 | 6/1988 | Forshaw | 254/124 X |

*Primary Examiner*—David A. Bucci
*Assistant Examiner*—Donald W. Underwood
*Attorney, Agent, or Firm*—Irving M. Kriegsman

[57] ABSTRACT

An article handling/supporting apparatus having a frame, a resolvable base attached to the frame, a turntable assembly mounted to the base, a main boom pivotally connected to the turntable assembly and a main article supporting arm pivotally connected to the main boom. Upon the release of a plurality of locking mechanisms, the turntable assembly is free to rotate while the main boom and the article support arm are free to move up and down. Once an operator has positioned the article handling/supporting apparatus in the desired location, the operator, by the release of a single button, can lock all of the movable components of the apparatus. In addition, fine adjustment of the components can be made from a single location by an operator even after the components have been locked in place.

17 Claims, 10 Drawing Sheets

PORTABLE ARTICLE HANDLING/SUPPORTING APPARATUS

BACKGROUND OF THE INVENTION

This invention relates generally to article handling devices, and, more particularly, to a portable article handling/supporting apparatus capable of being utilized by a single operator.

There are many instances when it is desirable for a individual to have the assistance of someone else either in lifting, moving or supporting equipment. During such times when assistance is unavailable, many a person has devised a makeshift support system only to find out that it was either not in the right position or incapable of safely supporting the article or equipment. Without the help of others it may be virtually impossible for an individual to accomplish many relatively simple tasks.

To date, the types of apparatus available to assist individuals in performing tasks of type set forth above generally have been cumbersome or lacking in the versatility necessary to effectively perform a wide variety of tasks. More specifically, the prior art can be exemplified by the following U.S. patents.

U.S. Pat. No. 3,850,307 discloses an article handling apparatus having a wheeled base and linkage arms articulated by an electric motor.

U.S. Pat. No. 3,630,389 discloses a material handling apparatus having an articulated boom with arm movement controlled by hydraulic actuators controlled by an electronic servosystem.

U.S. Pat. No. 4,564,179 discloses an articulated support arm in which the joints are movable between locked and unlocked positions. A foot value controls the locking and unlocking operation.

U.S. Pat. Nos. 4,548,373 and 4,517,632 disclose articulated linkages which incorporate therein releasable brakes. The release of the brakes is operator controlled.

U.S. Pat. No. 4,209,166 discloses a universal jack and work positioning mechanism having a coarse positioning adjustment, a locking device and a fine adjustment actuator.

U.S. Pat. No. 4,505,333 discloses an adjustable support wherein the linkage system has clamping devices urged by springs and released by the application of air pressure controlled by a switch.

U.S. Pat. No. 4,750,588 dislcoses a wheeled, load handling apparatus controlled by hydraulic actuators.

U.S. Pat. No. 4,177,002 discloses a robotic load handling apparatus.

U.S. Pat. No. 4,570,758 discloses a solenoid actuated release for a brake mechanism.

SUMMARY OF THE INVENTION

The present invention provides a portable article handling/supporting apparatus which has overcome the problems associated with load handling apparatus of the past and as exemplified by the prior art. More specifically, the portable article handling/supporting apparatus of this invention permits a single operator to effectively transport, lift and/or support a wide variety of articles such as tools and or equipment. The operator can, without the aid of others, move the apparatus to a desired location and can easily rotate, raise or lower the article holding end of the apparatus. Once in position the operator while situated substantially adjacent the article holding end effectively lock the apparatus in the desired position. Yet, if fine adjustment is still required, the operator, without substantially changing his or her position can make slight changes to the preselected locked position of the apparatus. The adjustments are made easily and do not effect the integrity or safety of the locking mechanism incorporated in the apparatus.

In addition, the apparatus can be readily moved, when in the unlocked position, from a very low-to-the ground position to the maximum height by manually raising the article holding end. Furthermore, if desired the apparatus of this invention can either be free standing and easily movable from location to location or be attached to an auxilary support such as the bed of a pick-up truck.

It is therefore an object of this invention to provide a portable article handling/supporting apparatus which can be readily used by a single individual.

It is another object of this invention to provide an article handling/supporting apparatus which enables an operator to effect both complete locking as well as fine adjustment of the apparatus from substantially the same location adjacent the article handling end of the apparatus.

It is a further object of this invention to provide an article handling/supporting apparatus which is lightweight, sturdy, compact and economical to manufacture.

For a better understanding of the present invention, taken together with other and further objects thereof, reference is now made to the detailed description of the invention taken in conjunction with accompanying drawings, and its scope will be set forth in the appended claims.

DETAILED DESCRIPTION OF THE PREFERRED EMBODIMENT

Figure 1:
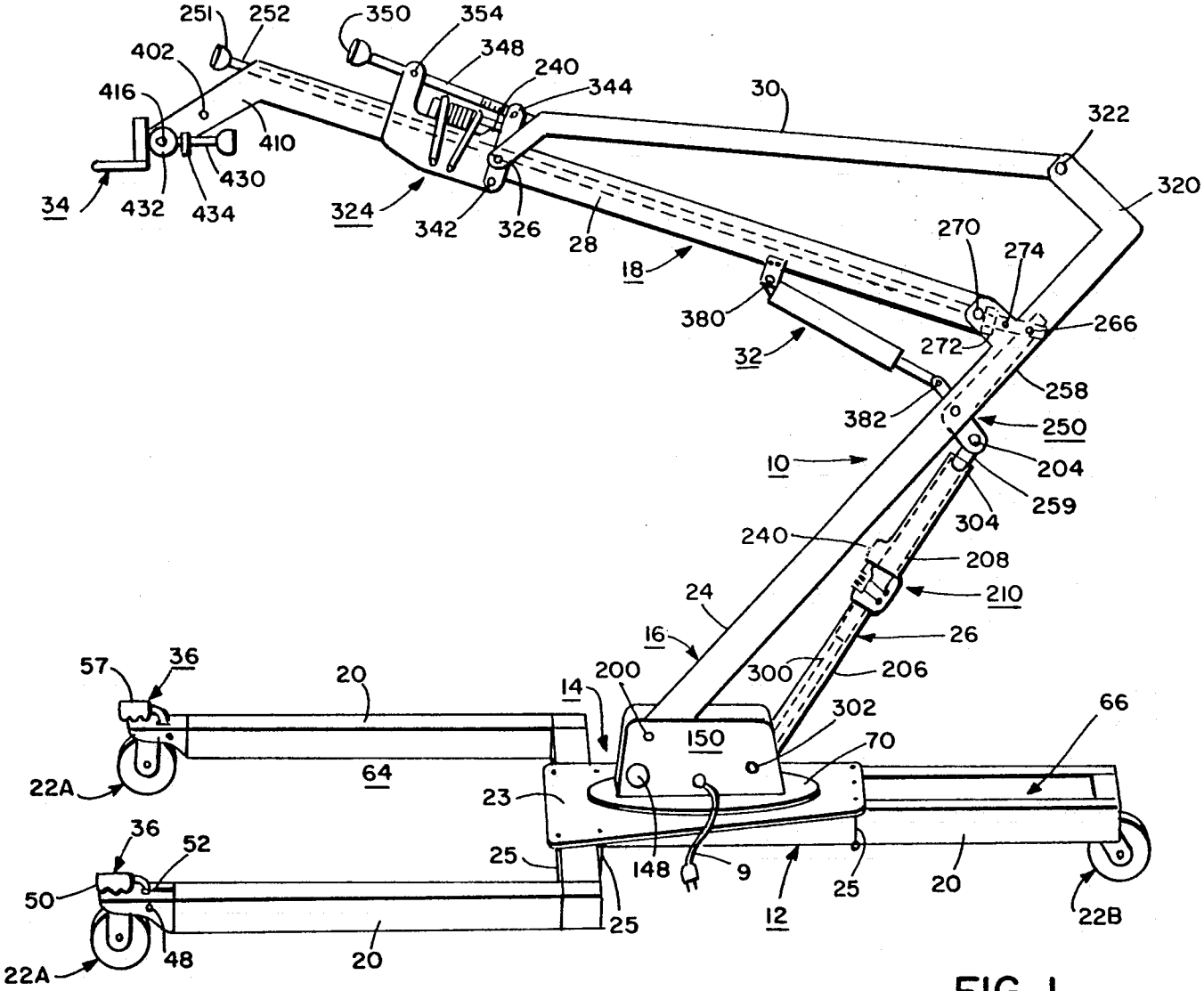
FIG. 1 is a pictorial view of the portable article supporting/handling apparatus of this invention.
Figure 2:
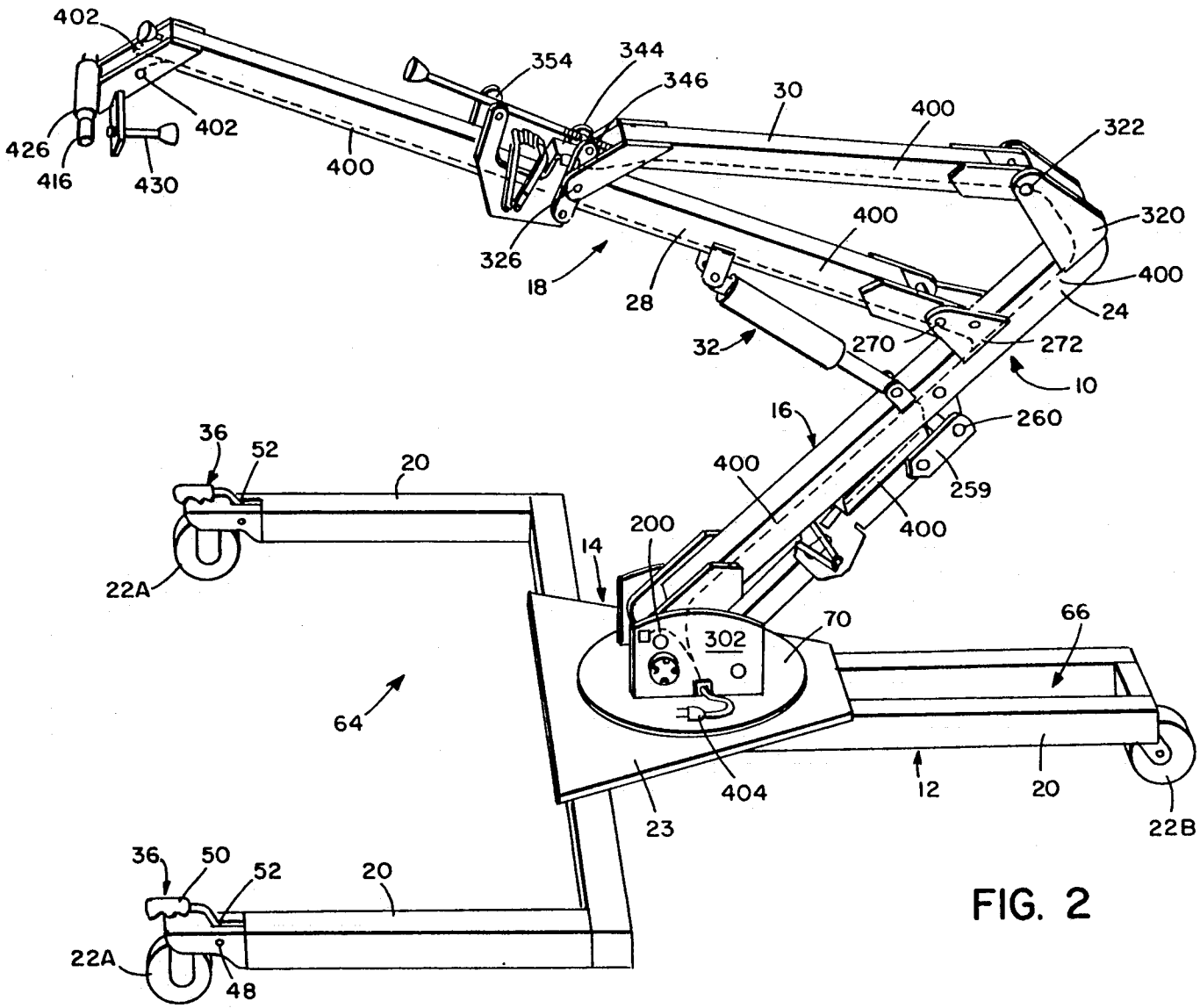
FIG. 2 is a more detailed pictorial view of the portable article supporting/handling apparatus of this invention.

Reference is now made to FIGS. 1 and 2 of the drawings which clearly illustrate in pictorial fashion the portable article handling/supporting apparatus 10 of this invention. Apparatus 10 is made up of the following main components: a movable base or support 12; a turntable assembly 14; a main boom assembly 16 and a main arm assembly 18.

More specifically, and still referring to FIGS. 1 and 2, base or support 12 is made up of a frame 20 fabricated from any rigid material such as steel or aluminum. Frame 20 can be configured in any desired shape having a pair of wheel asemblies 22A and a caster assembly 22B attached to the bottom thereof. The wheel assemblies 22A have locking mechanisms associated therewith such that apparatus 10 can be easily moved to any desired location and then locked in place in a manner to be described in detail hereinbelow. The turntable assembly 14 is rotatably mounted upon a base plate 23 which is affixed to frame 20 by any suitable securing means such as U-bolts 25. Turntable assembly 14 is therefore capable of rotational movement with respect to support 12 in a manner to be described in greater detail below. As a result of having base plate 23 detachably or removably secured to frame 20, it is possible for an operator to remove base plate 23 from frame 20 and, under certain circumstances mount base plate 23 directly to another support such as, for example, the body of a pick-up truck (not shown). Such an arrangement substantially increases the versatility of the article handling and supporting apparatus 10 of the present invention.

Main boom assembly 16 is pivotally attached to turntable 14 and includes a main boom 24, a main boom support 26 and associated positioning/locking mechanisms to be described in greater detail. Main arm assembly 18 is pivotally attached to main boom 24 and includes a main arm 28 an upper support arm 30, a shock absorber 32 and associated positioning/locking mechanisms to be described hereinafter. One of any number of interchangeable article or work holders 34 can be removably attached to the end of main arm 28.

Figure 3:
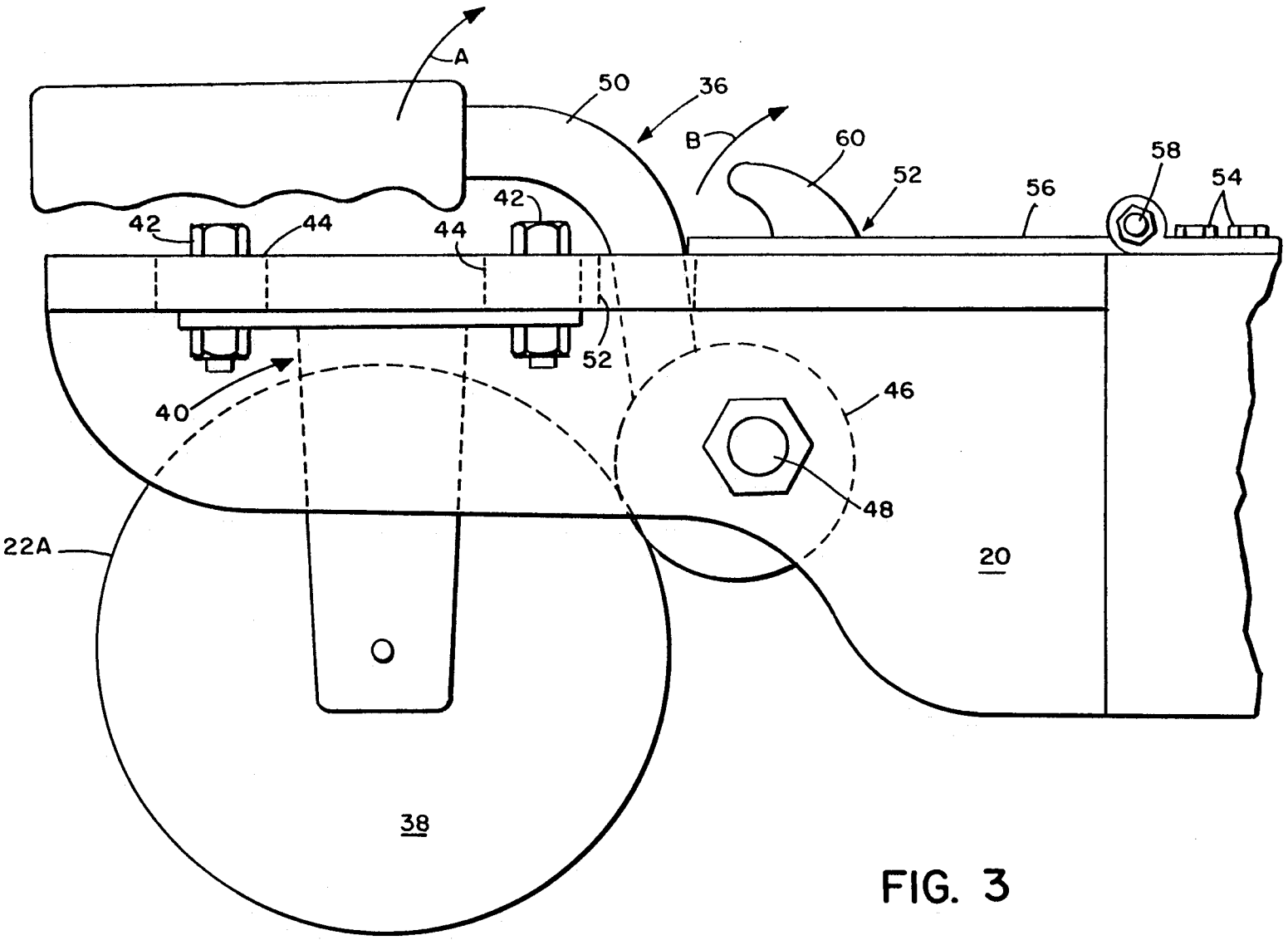
FIG. 3 is an enlarged side elevational view of one of the wheel assemblies and its associated locking mechanism.

Reference is now made to FIG. 3 of the drawings which depicts in exaggerated fashion one of the wheel assemblies 22A and the locking mechanism 36 associated therewith. More specially, wheel assembly 22A is made up of any suitable wheel 38 rotatably mounted within a housing 40. Housing 40 is fastened to frame 20 by any suitable fastening means such as bolts 42. Bolts 42 pass through bolt holes 44 within frame 20. In order to adjust the position of wheel assembly 22 relative to frame 20, holes 44 are enlongated in configuration.

Locking mechanism 36 is made up of a cam-like element 46 pivotally mounted to frame 20 in an off-center relationship by means of bolt 48. Fixedly secured by welding, for example, to cam-like element 46 is an elongated handle 50, Handle 50 protrudes through and may be moved within an enlongated slot 52 in frame 20. Hnadle 50 is capable of being moved from a wheel locking position (as shown in FIG. 3) in which cam-like element 46 bears against wheel 38 to a wheel releasing position in which handle 50 together with element 46 is rotated in the direction of arrow A. In the wheel releasing position handle 50 is positioned in a substantially upright position and cam-like element 46 is disengaged from wheel 38 (not shown). A safety latch 52 is utilized to secure handle 50 in its wheel locking position as shown in FIG. 3. Safety latch 52 is secured by bolts 54 to frame 20 and has a portion 56 thereof pivotable about hinge 58. In the position shown in FIG. 3, safety latch 52 bears against handle 50 and prevents handle 50 from being inadvertantly raised. By locking handle 50 in place, cam-like element 46 is prevented from inadvertantly becoming disengaged from wheel 38. When it is desired to release locking mechanism 36, a latch handle 60 affixed to portion 56 of safety latch 52 is pivoted out of the way (in the direction of arrow B) to permit an operator to raise handle 50 in the direction of arrow A.

In the embodiment of apparatus 10 shown in the drawings, each of the wheel assemblies 22A have a locking mechanism 36 associated therewith while the caster assembly 22B (see FIGS. 1 and 2) at the other end of frame 20 does not have a locking mechanism. The use of a caster assembly 22B in conjunction with wheel assemblies 22A permits apparatus 10 to be easily rolled to a multitute of different positions.

Referring once again to FIGS. 1 and 2 of the drawings, it should be noted that frame 20 is configured such that spaces or openings are provided between the frame 20. These openings 64 and 66 are utilized to accommodate main boom assembly 16 and main arm assembly 18 when they are lowered. In the completely down or lowered position (not shown) boom assembly 16 and arm assembly 18 fit within openings 64 and 66. In this retracted position, apparatus 10 can be easily rolled underneath and utilized with low objects such as an automobile. For example, in the retracted position an operator can utilize apparatus 10 to lift and/or support a muffler for installation beneath an automobile.

Figure 4:
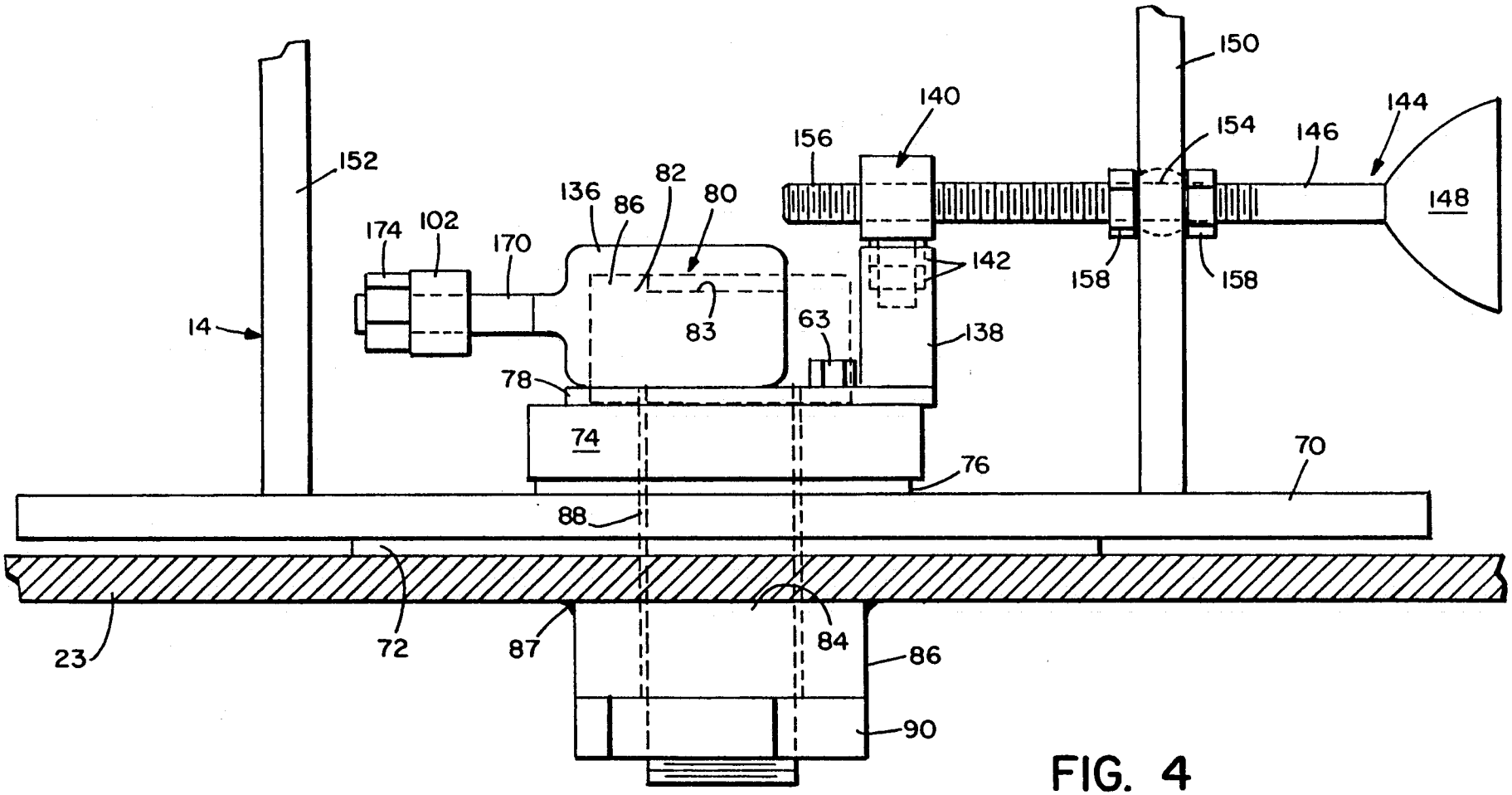
FIG. 4 is a segmented front end view of the turntable assembly of the article supporting/assembly handling apparatus of this invention shown partly in cross-section.
Figure 5:
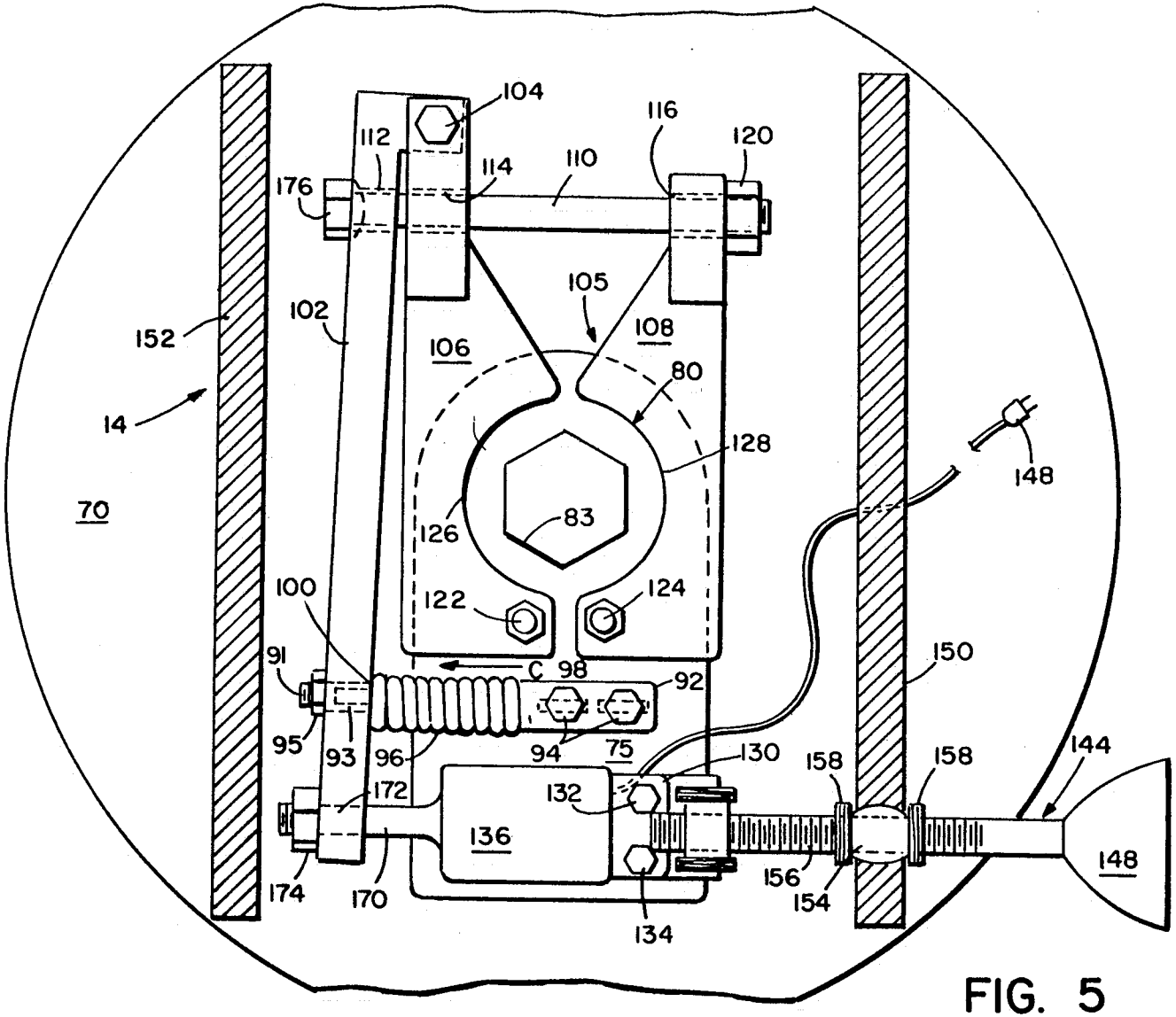
FIG. 5 is a segmented top view of the turntable assembly of the article handling/supporting apparatus of this invention shown partly in cross-section.

Reference is now made to FIGS. 4 and 5 of the drawings for a detailed description of turntable assembly 14, with selected components omitted therefrom for clarity. As shown in FIGS. 1 and 2 turntable assembly 14 is rotatably mounted upon base plate 23. More specifically, turntable assembly 14 is made up of a turntable plate 70, a large washer 72, preferably made of brass, interposed between turntable plate 70 and baseplate 23; a mounting plate 74; a smaller brass washer 76 interposed between mounting plate 74 and turntable plate 70. A brass washer 78 is interposed between mounting plate 74 and the head of a preferably Allen-type bolt 80. Bolt 80 passes through the above-mentioned components in a manner described below.

Bolt 80 has a large round head 82 with an Allen-type slot 83 therein. The shank 84 of bolt 80 passes through the apertures within washer 78, mounting plate 74, washer 76, turntable plate 70, washer 72 and base plate 23. A nut 86 is secured to the bottom of base plate 23, preferably by welding at 87. Nut 86 is aligned with aperture 88 of plate 23. Shank 84 of bolt 80 is threaded into nut 86 and tightened until the turntable plate 70 and mounting plate 74 are held together relatively securely, yet slightly rotabled with respect to base plate 23. At this point turntable plate 70 and mounting plate 74 can still rotate 360 degrees about bolt 80 with slight resistance. Thereafter, a lock nut 90 is threaded onto the end of shank 84 of bolt 80 in order to secure bolt 80 to base plate 23 and therefore prevent bolt 80 from rotating with respect thereto. In other words, bolt 80 is now fixedly secured to base plate 23 while mounting plate 74 and turntable plate 70 can independently rotate thereareound.

Still referring to FIGS. 4 and 5, mounting plate 74 contains a spring holder 92 (See FIG. 5) adjustably held in position thereon by bolts 94. A spring 96 is positioned on holder 92 and is fixed thereto at one end 98 thereof. The other end 100 of spring 96 bears against arm 102. The other end 91 of spring holder 92 is threaded and passes through an opening 93 in arm 102. Nut 95 secures end 91 in place. Spring 96 bears against arm 102.

As shown in FIG. 5, arm 102 is pivotally mounted by pin 104 to one of a pair of pivotally mounted brake shoes 106 of braking mechanism 105 in a manner to be described in greater detail hereinafter. Spring 96 is of the type which normally extends outwardly in the direction of arrow C thereby biasing arm 102 in the same direction.

As clearly shown in FIG. 5, an elongated bolt 110 passes through opening 112 in arm 102, opening 114 in brake shoe 106 and opening 116 in brake shoe 108. The head of bolt 110 rides in an indentation 118 in arm 102 while a nut 120 secures the other end of bolt 110 to brake shoe 108. The brake shoes 106 and 108 are pivotally mounted upon mounting plate 74 by bolts 122 and 124, respectively. The inner brake surfaces 126 and 128 of brake shoes 106 and 108, respectively, one capable of bearing against the head 86 of bolt 80. It is readily apparent from the above description taken in conjunction with FIG. 5 that normally spring 96 biases arm outwardly in the direction of arrow C which causes brake shoes 106 and 108 to bear against bolt 80. This braking of locking action causes mounting plate 74 to become fixed with relation to both bolt 80 and base plate 23.

At this point turntable plate 70 is still free to rotate about bolt 80 between mounting plate 74 and base plate 23. In order to prevent this rotation from taking place, a plate 130 is affixed via bolts 132 and 134 to mounting plate 74 in order to mount a solenoid 136 and tower 138 thereon. In FIG. 4 of the drawings, plate 130 is shown in soild lines while washer 78 is shown in dotted lines behind plate 130. As can be clearly seen in FIG. 4, a pivotable linkage 140 is threaded into tower 138 and held in place thereon by a pair of locking nuts 142. A turntable fine adjustment rod 144 having a threaded shank 146 and a knob 148 passes through boom support bracket 150 of the pair of boom support brackets 150 and 152. It is held in place by ball joint 154 located within bracket 150. The brackets 150 and 152 are fixedly secured, preferably by welding, to turntable plate 70. The threaded end 156 of shank 146 threadably engages pivotable linkage 140 on tower 138. Lock nuts 158 hold fine tuning rod 144 from the horizontal movement through ball joint 154. This interconnection between turntable plate 70 and mounting plate 74 locks the movement of turntable plate 70 when the mounting plate 74 is fixedly secured to bolt 80 by brakes shoes 106 and 108.

When the brake shoes 106 and 108 bear against the head 86 of bolt 80 as a result of the pressure applied to arm 102 by spring 96, the mounting plate 74 and turntable plate 70 are locked to bolt 80 and therefore are immobile. Even though turntable plate 70 is locked in place, it can be rotated for fine adjustments by turning knob 148. Rotating knob 148 moves threaded shank 146 in or out of pivotable threaded linkage 140. This fine adjustment permits turntable plate 70 to move slightly with respect to the fixed mounting plate 74 and fixed base plate 23.

In order for turntable plate 70 to move freely, the operator needs only to release brake mechanism 105 from bearing against head 86 of bolt 80. This is accomplished by the activation of solenoid 136. More particularly, solenoid 136 is secured to plate 130 which is mounted on plate 74 as described hereinabove and shown in FIG 5. The activation rod 170 of solenoid 136 is attached to the furthest end of arm 102 by passing through aperture 172. A nut 174 secures rod 170 to arm 102. In its uttermost position as shown in FIG. 5, arm 102 bears against nut 174 because of the biasing action of spring 96 pushing arm 102 in the direction of arrow C. Activation of solenoid 136 retracts rod 170 into solenoid 136. The movement of rod 170 brings in arm 102 and compressing spring 96. This action relaxes the tension of arm 102 on the head 176 of bolt 110. By this inward movement of arm 102, brake shoes 106 and 108 release their grip on head 86 of bolt 80 thereby allowing the mounting plate 74 and turntable plate 70 to rotate freely around bolt 80.

Deactivation of solenoid 136 permits spring 96 to move arm 102 in the direction of arrow C and once again apply braking mechanism 105. The electrical connection of solenoid 136 as well as the other electrical components will be described in detail below during a later portion of the detailed description of this invention.

Figure 6:
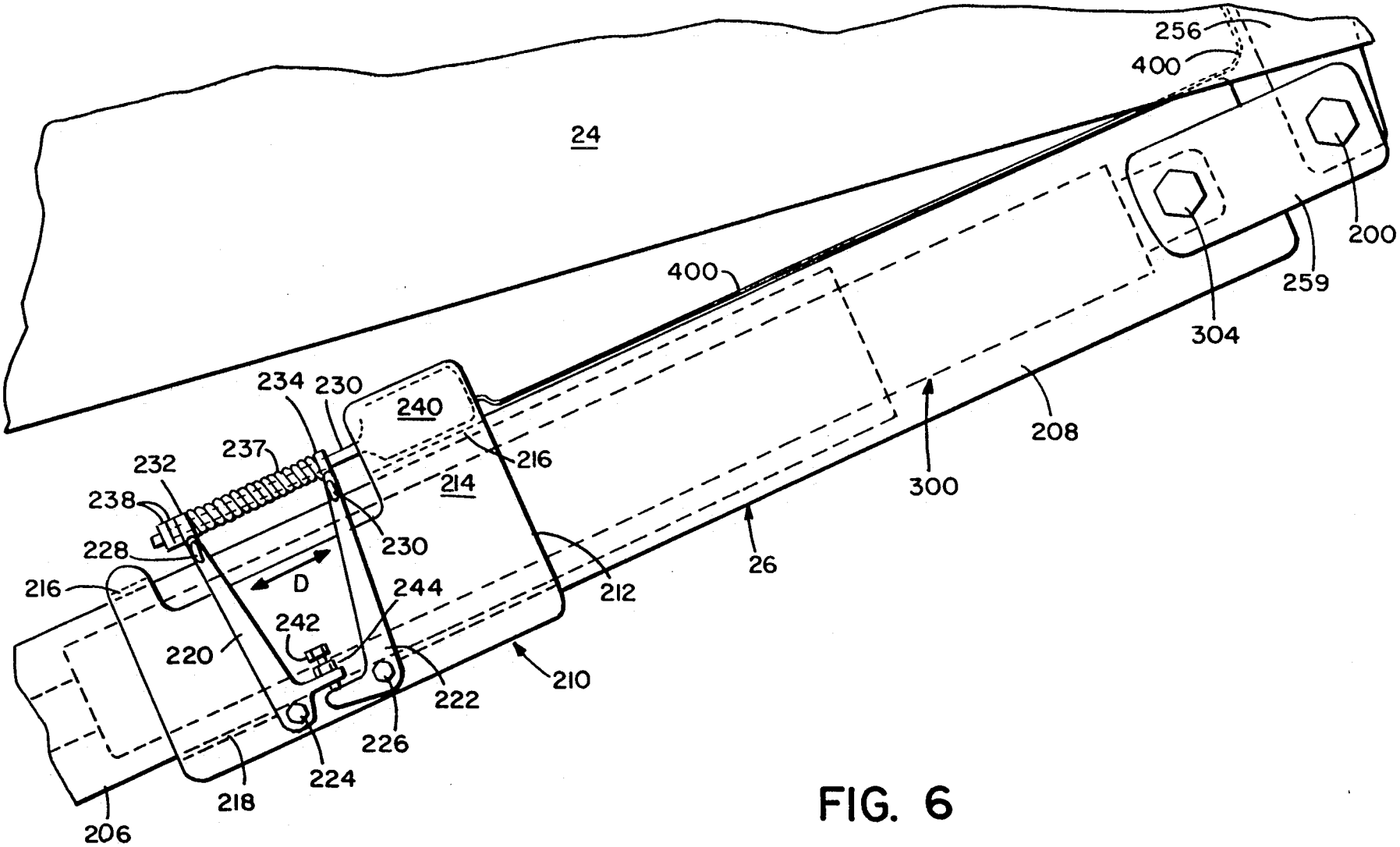
FIG. 6 is a segmented side elevational view of the main boom support tube and the associated clamping device of the article handling/supporting apparatus of this invention.
Figure 7:
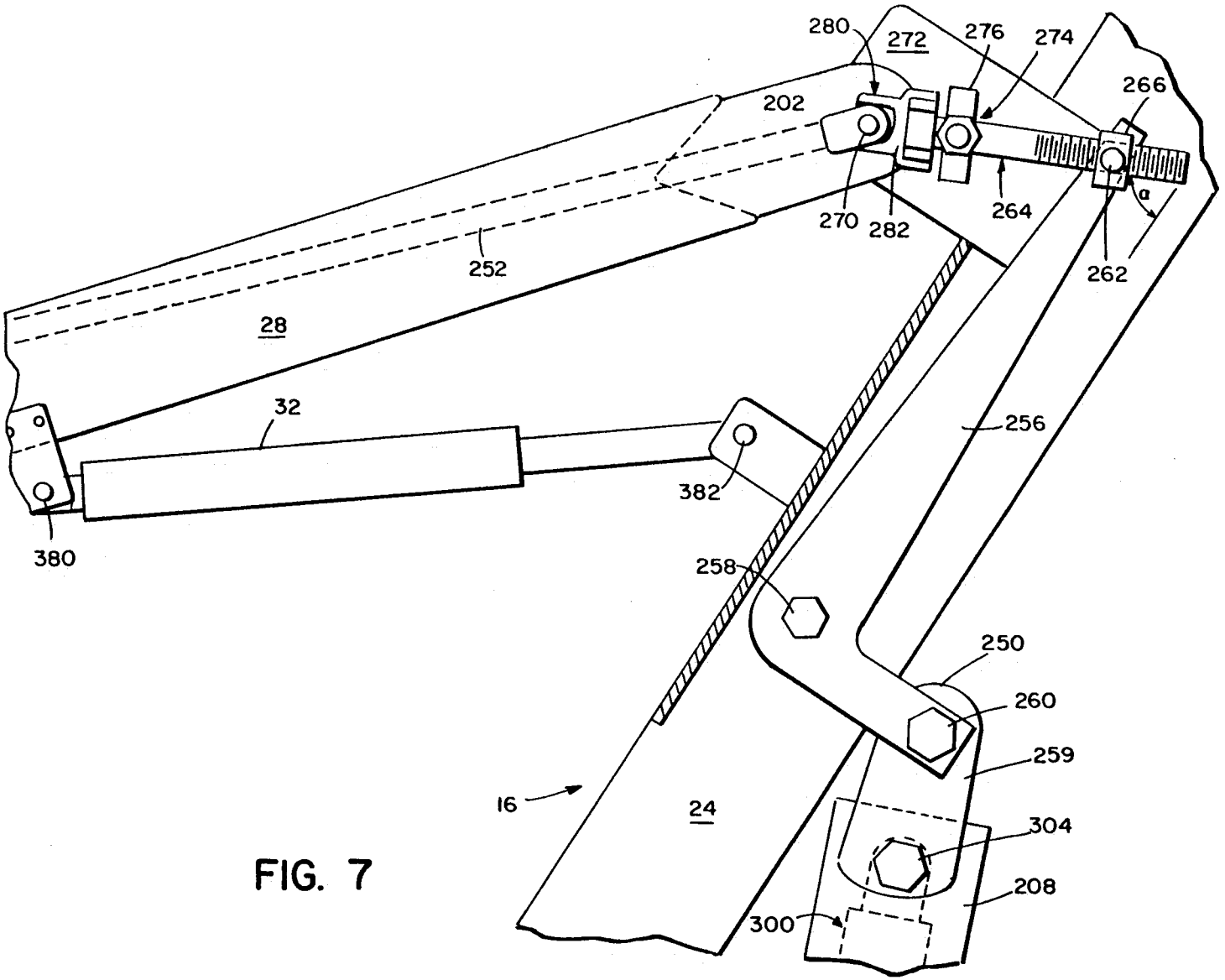
FIG. 7 is a side elevational view of the fine adjustment mechansim utilized in conjunction with the main boom assembly of the article handling/supporting apparatus of this invention.

Reference is now made to FIGS. 1, 6 and 7 for a clear depiction and description of the main boom assembly 16. As shown in FIG. 1, main boom assembly 16 includes a main boom 24 pivotally secured at its lower end by pivot pin 200 between support brackets 150 and 152, and a main boom support 26 pivotally secured at its lower end by pivot pin 202 between brackets 150 and 152. At its upper end boom support 26 is pivotally secured by pin 204 indirectly to main boom 24. More specifically, main boom support 26 is made up of boom adjusting legs 206 and 208.

Referring to FIG. 6 of the drawings, leg 208 is preferably contructed of square tubing of predetermined size while leg 206 is also of square tubing but of a smaller size so that it can telescope within leg 208. A clamping device 210 is welded to an end 212 of leg 208 and circumscribes telescoping leg 206. With clamping device 210 positioned about lower leg 206 as shown in FIG. 6, in its normal position it locks onto leg 206 in a manner to be described in detail below. This locking action fixedly positions main boom assembly 16 in a desired position.

Still referring to FIG. 6, clamping device 210 is formed of two justaposed side plates 214 and top and bottom plates 216 and 218, respectively, depicted by dotted lines in FIG. 6. Plates 216 and 218 form a housing around leg 206 which is slightly larger than the enterior of leg 206 and enables leg 206 to freely slide therethrough.

A pair of brake arms 220 and 222 are pivotally connected to each side plate 214 by bolts 224 and 226. Each of the brake arms 220 and 222 are respectively affixed to each other over the top of leg 206 by cleats 228 and 230. Cleats 228 and 230 bear against leg 206 to hold it securely in position within leg 208 in a manner to be described in detail below.

Located centrally at the top of each cleat 228 and 230 is an upstanding portion 232 and 234, respectively, having aligned openings therein through which rod 236 passes. One end of rod 236 is secured to cleat 228 by a pair of adjustable lock nuts 238 while the other end of rod 236 is interconnected to solenoid 240 in a conventional manner.

Solenoid 240 is fixedly secured to the side plates 214 of clamping device 210 by bolts (not shown). Interposed between cleats 228 and 230 and surrounding rod 236 is a spring 237 which normally biases brake arms 220 and 222 in opposite directions as shown by arrows D in FIG. 6. This arrangement prevents legs 206 and 208 from separating, and in essence, acts like "chinese handcuffs"—the harder the pressure is applied to leg 206, the tighter cleats 228 and 230 dig into leg 206.

In order to release brake arms 220 and 222 and free main boom 16 for movement, the operator merely activates solenoid 240. Activation of solenoid 240 pulls rod 236 into solenoid 240. This action of rod 236 compresses spring 237 and rotates brake arm 220 clockwise about pivot pin 224. The rotational movement of brake arm 220 forces an adjustable bolt 242 held in position by lock nut 244 to bear down against brake arm 222 as shown in FIG. 6 causing brake arm 222 to rotate about pin 226 in the counter clockwise direction. The movement of brake arm 222 in the counter clockwise direction further compresses spring 237 and eliminates the clamping or braking effect of cleats 238 and 230 on leg 206. Leg 206 is therefore able to freely slide within leg 208 as long as solenoid 240 remains activated.

Reference is now made to FIGS. 1 and 7 for a detailed descriptic.. of the fine adjustment mechanism 250 for main boom 24. Fine tuning or adjustment of main boom 24 is performed with solenoid 240 deactivated and the legs 206 and 208 locked in a preselected position with respect to each other. In order to locate the fine adjustment control knob 251 of control rod 252 (as shown in FIG. 1) as close to the article or work holding end of apparatus 10 of this invention, the fine adjustment mechanism 250 had to be incorporated within the top portion of boom adjusting leg 208.

More specifically, main boom 24 is preferably constructed of a three-sided tube or channel iron with the bottom side 254 open to permit the components of fine adjustment mechanism 250 to be accessible. The fine adjustment mechanism 250 includes a pair of juxtaposed L-shaped lever arms 256 (one of which being shown in FIG. 7) spaced apart by a bushing (not shown) at pin 258. The specific arrangement of lever arms 256 permit one end of the arms 256 to straddle ear 259 which protrudes from leg 208 at pin 260. The other end of arms 256 straddle bolt 262 of connecting mechanism 264. Connecting mechanism 264 interconnects lever arms 256 to control rod 252 which is located within main arm 28. Connecting mechanism 264 also includes an internally threaded linkage member 266 through which bolt 262 is threaded.

As shown in FIG. 1, main arm 28 is pivotally affixed to main boom 24 by a pair of pins 270 which pass through each of the juxtaposed ears 272, respectively. Now referring to FIG. 7, situated between and secured to ears 272 is a pivot device 274. In the center of pivot device 274 is a bearing 276 through which bolt 262 passes. The bearing 276 is secured in such a manner that bolt 262 can only turn about its now longitudinal axis.

Referring once again to the attachment of main arm 28 to ears 272, there are two pins 270 utilized in this pivotal connection. Two pines 270 are necessary in order to make room for the interconnection between fine adjustment rod 252 and bolt 262 via a conventional socket type universal joint 280. The utilization of two pivot pins 270 permits the axis of rotation for main arm 28 about pins 270 to be coincidental with the pivot point of rod 252 with respect to universal joint 280. The socket 282 of universal joint 280 is fixedly positioned upon the head 284 of bolt 262 by any suitable securing means such as welding. Adjustment rod 252 is secured to the other end 286 of universal joint 280 and pivots about the same pivot point as pins 270 as described above.

Still referring to FIG. 7, bolt 262 is mounted by means of linkage member 266 and bearing at an angle, $\alpha$, of approximately 65 degrees with respect to the longitudinal axis of main boom 24 when lever arms 256 are in a "neutral" position. The neutral position occurring when linkage member 266 is approximately half-way up the threads on bolt 262. The angle, $\alpha$, may vary between 50 and 75 degrees since any angle outside that range could adversely affect the operation of connecting mechanism 264. Utilizing an optimum angle of 65 degrees permit universal joint 280 to operate fine adjustment mechanism 250 when main arm 24 is either pivoted parallel to main boom 24 or in any arc of up to 130 degrees from the lower end of main boom 24.

Before utilizing the fine adjustment mechanism 250, the operator must deactivate solenoid 240 in order to fixedly mount leg 206 within leg 208. Thereafter, the operator can rotate knob 251. Rotation of knob 251 turns rod 252 which in turn rotates universal joint 282 and socket 282. Rotation of socket 282 turns bolt 262. Since bolt 262 is anchored within bearing 276, only free to rotate therein, the threaded linkage member 266 will move up or down threaded bolt 262 in accordance with either the clockwise or counter clockwise rotation of knob 251. The movement of linkage member 266 along bolt 262 causes lever arms 256 to pivot about pins 260 and 258 thereby slightly raising or lowering main boom 24.

Main boom support tube 26 also contains therein a conventional spring loaded shock absorber 300. As shown in FIG. 1, shock absorber 300 is secured at one end thereof by pin 302 to the interior of leg 206. The other end of shock absorber 300 is secured to the inside of leg 208 by pin 304. Pin 304 also protrudes through leg 208 and fixedly attaches ear 259 thereto. When clamping device 210 is in its clamping position and legs 206 and 208 are locked together for no relative movement therebetween, the spring loaded shock absorber has no effect. However, if the clamping device 210 accidently fails to hold and releases leg 206 so it is free to move within leg 208, shock absorber 300 absorbs the weight of the main boom 24 as it lowers. Consequently, shock absorber 30 acts as a safety device. Additionally, when the operator has released clamping device 210 and intentionally frees leg 206 for movement into and out of leg 208, spring shock absorber 300 acts as an aid in moving main boom 24 to its desired position. This is accomplished by the conventional action of the compressed spring (not shown) within shock absorber 300 creating an outward force to aid the operator in lifting main boom 24.

Figure 8:
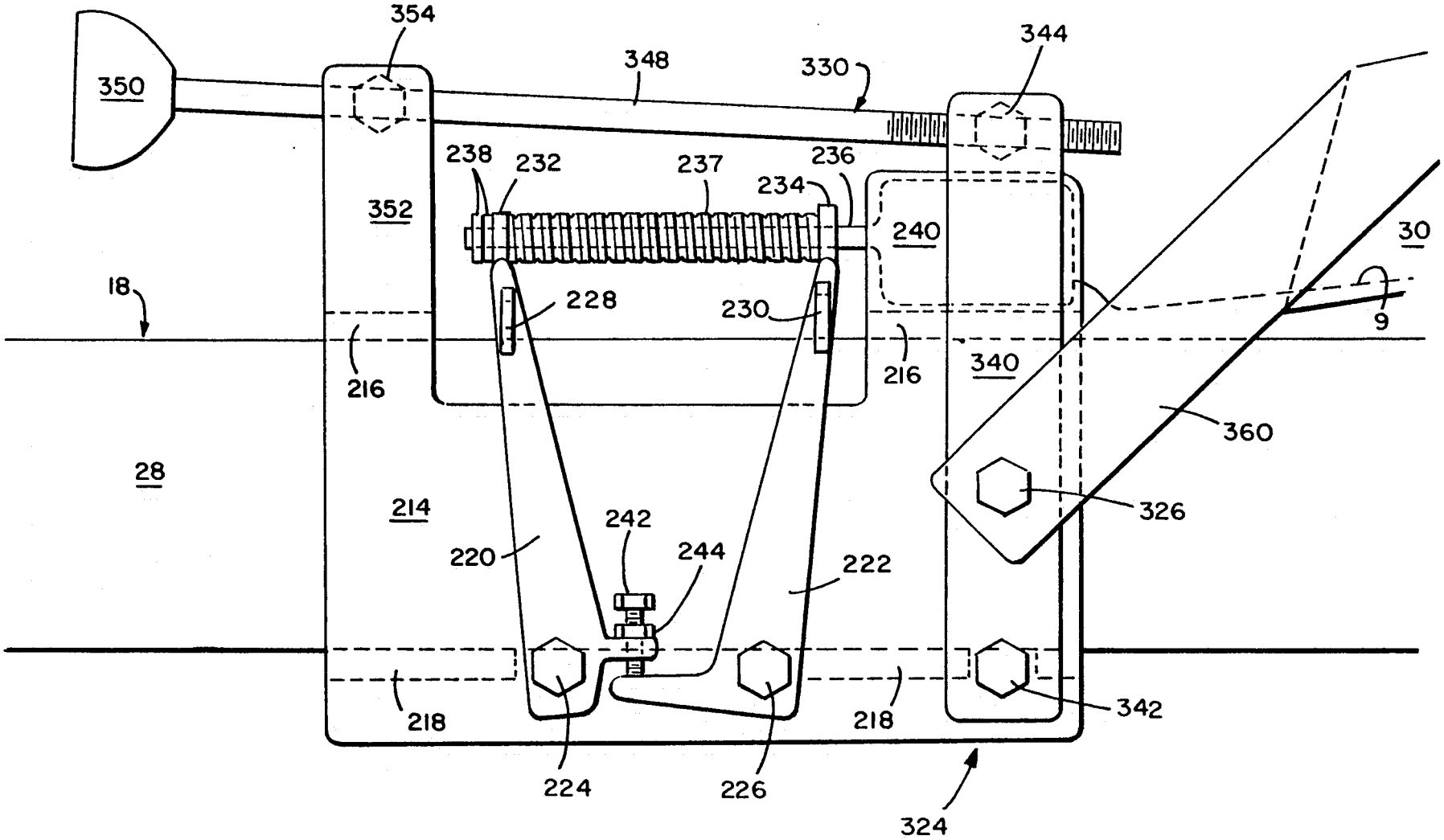
FIG. 8 is a segmented side elevational view of the main arm assembly and the associated clamping device of the article handling/supporting apparatus of this invention.

Referrence is now made to FIGS. 1 and 8 for a detailed description of main arm 28 and the components which work in conjunction therewith. As shown in FIG. 1, main arm 28 is pivotally mounted to ear 272 which is pivotally affixed to main boom 24. Supporting main arm 28 is an upper support arm 30 pivotally secured at one end between a pair of extensions 320 (see FIG. 2) by pin 322. The other end of upper support arm 30 is pivotally secured about a clamping device 324 by pair of pins 326.

In order to move clearly understand the operation of clamping device 324 reference is now made to FIG. 8. Since clamping device 324 is similar in many aspects to clamping device 210, like elements utilized therewith will be given the identical reference numerals utilized in describing clamping device 210. As shown in FIG. 8 clamping device 324 encompasses main arm 28 and therefore in its non-clamping position permits main arm 28 to slide therein and move relative to upper support arm 30. When the brake arms 220 and 222 are moved apart by spring 237 such that cleats 228 and 230 engage main arm 28, main arm 28 becomes fixed with respect to super support arm 30 and is incapable of moving. Main arm 28 can be raised or lowered in a similar fashion as main boom 24 when solenoid 240 is activiated and rod 236 is withdrawn into solenoid 240 thereby moving brake arms 220 and 222 inwardly in the manner described in detail with respect to clamping device 210.

As shown in FIG. 8, the fine adjustment mechanism 330 associated with clamping device 324 is different from the fine adjustment mechanism 250 associated with clamping device 210. More specifically, there is an arm 340 (only one being shown in FIG. 8) on each side of clamping device 324 pivotally mounted to a respective side plate 214 by pin 342. At the top of each arm 340 and above solenoid 240 is a threaded block 344 which is attached to a pivot rod 346 seen more clearly in FIG. 2. A threaded fine adjustment rod 348 has an end thereof passing through block 344. The other end of rod 348 terminates in a knob 350. At the other end of each side plate 214 is an extension 352. In between extensions 352 is a bearing/pivot member 354 (see FIG. 2) through which rod 348 extends. Member 354 permits rod 348 to only pivot and rotate about its own axis. In other words, rod 348 is in capable of being displaced longitudinally with respect to extensions 352. As set forth above, upper support arm 30 has extensions 360 thereon which are pivotally attached to arms 340 by means of pins 326 (see FIGS. 2 and 8).

When clamping device 324 is locked onto main arm 28, fine adjustment of main arm 28 can be made by rotating knob 350 of rod 348. Since rod 348 is secured at bearing/pivot member 354, threaded block 344 rides up and down rod 348 when it is rotated. Movement of threaded block 344 causes side arms 340 to move forward or backward on pivot pin 342. The movement of side arms 340 when clamping device 324 is in engagement with main arm 28 causes slight movement or adjustment of main arm 28 about pin 270 (see FIGS. 1 and 2) relative to main boom 24.

As shown in FIG. 1 of the drawings, also associated with main arm 28 is a conventional spring shock absorber 32 which is pivotally secured at one end thereof by pin 380 to main arm 28 and at the other end thereof by pin 382 to main boom 24. Shock absorber 32 acts in a similar manner to shock absorber 300. When clamping device 324 is inadvertantly released, shock absorber 300 acts as a safety device. Under normal conditions, when clamping device 324 is intentionally released, shock absorber 32 aids the operator in the movement of main arm 28 to its desired position.

As shown in FIG. 2 of the drawings, the movement of main arm 28 is effected by the activation of the solenoids 136 and 240 associated with the turntable assembly 14, the main boom assembly 16 and the main arm assembly 18. Activation of the solenoids released all the clamping or locking mechanisms so that the main arm 28 can be easily moved manually by an operator to any desired position. Solenoid 136 and the two solenoids 240 are electrically interconnected by wires 400 as shown in FIG. 2. The wires terminate at a pair of activation buttons 402 shown clearly in FIG. 9. The activating means for the solenoids are positioned close to the end of main arm 28 as possible. Two activation buttons 402 are utilized in order to give the operator access to an activation button 402 on either side of main arm 28.

The electrical power for the solenoids 136 and 240 is supplied to apparatus 10 by means of electrical connector 404 shown in FIGS. 2 and 5. The solenoids preferably operate on a 12 volt power supply in order to permit electrical connector 404 of apparatus 10 to be electrically connected to a car battery if apparatus 10 is mounted on a vehicle.

Electrical connector 404 can also be connected to an AC power source by way of a conventional adapter (not shown). Individual activation buttons can also be associated with each of the solenoids 136 and 240 if desired. By pressing one of the activation buttons 402 all solenoids can be activated simultanously. Individual solenoids could be selectively activated by separate activation buttons if such an arrangement was desired.

Figure 9:
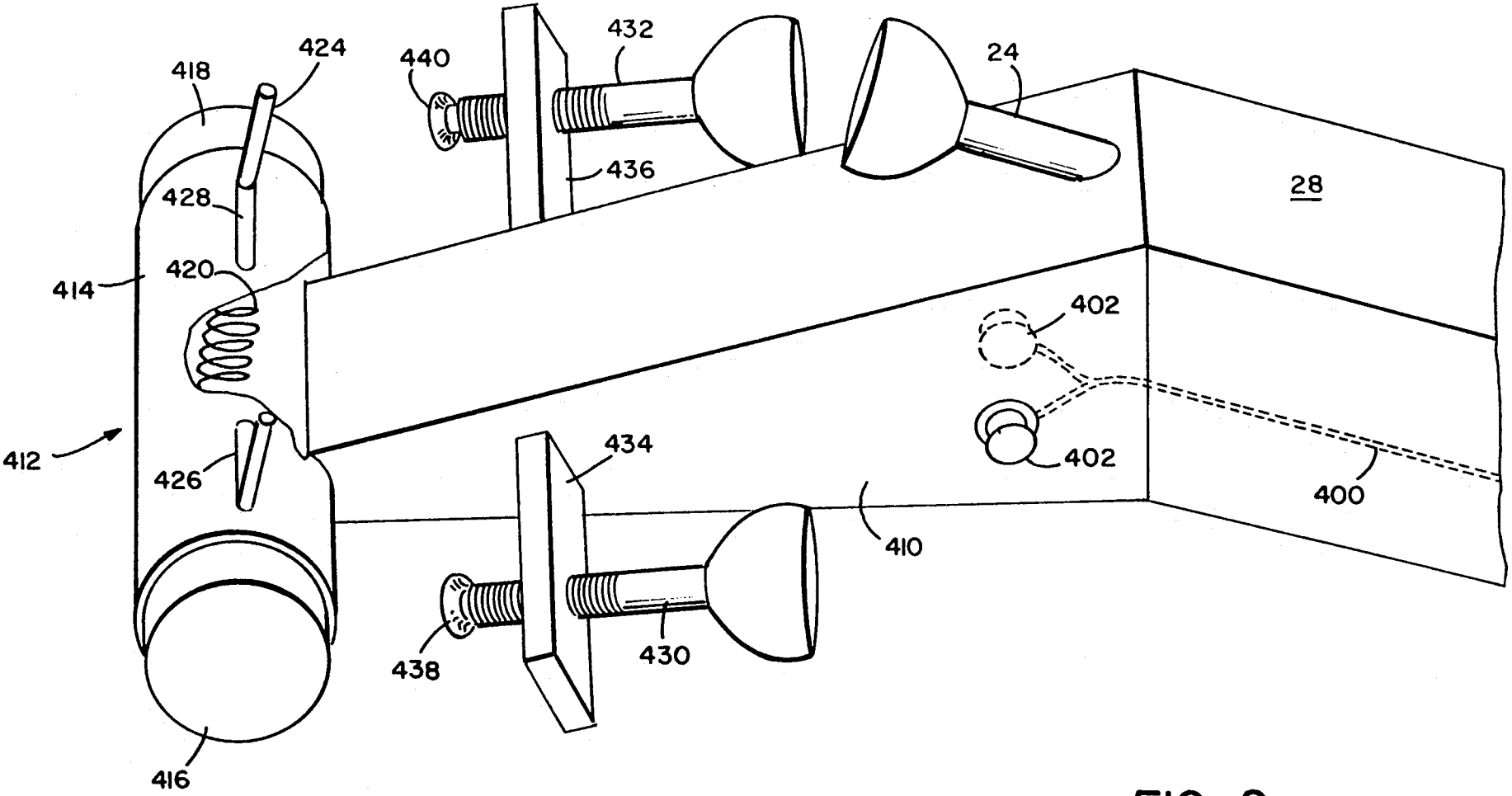
FIG. 9 is a perspective view of the end of the main arm of the article handling/supporting apparatus of this invention illustrating the means of attaching an article holder thereto.

For a detailed description of the article or work holder 34 reference is now made to FIGS. 1, 2, 9 and 10 of the drawings. As shown in FIG. 9, the end 410 of main arm 28 has affixed thereto, preferably by welding, a holder support bar 412 made up of a hollow tube 414 preferably fabricated from steel. Tube 414 has a pair of spring biased tool holder pines 416 and 418 protruding from each end thereof. A centrally located spring 420 is positioned against the interior end surfaces of pins 416 and 418 to bias pins 416 and 418 in the outward direction under normal circumstances. Each pin 416 and 418 has a retractor lever 422 and 424, respectively, secured thereto. The retractor pins 422 and 424 protrude through respective slots 426 and 428 in tube 414. In order to move tool holder pins into tube 414 and allow the attachment of article holder 34 thereto, the retractor levers 422 and 424 are pushed toward the center of tube 414 compressing spring 420 and permitting tool holder 34 to be attached thereto in the manner described below.

Also mounted to end 410 of main arm 28 are a pair of threaded adjusting knobs 430 and 432. The adjusting knobs 430 and 432 threadably engage a pair of protrusions 434 and 436, respectively, secured, preferably by welding, to end 410 of arm 28. The adjusting knobs 430 and 432 have gripping surfaces 438 and 440, respectively, which bear against cam surfaces 442 and 444, respectively, onto holder 34 clearly illustrated in FIG. 10 of the drawings. The unique manner in which article holder 34 mounts on main arm 28 is described below.

Figure 10:
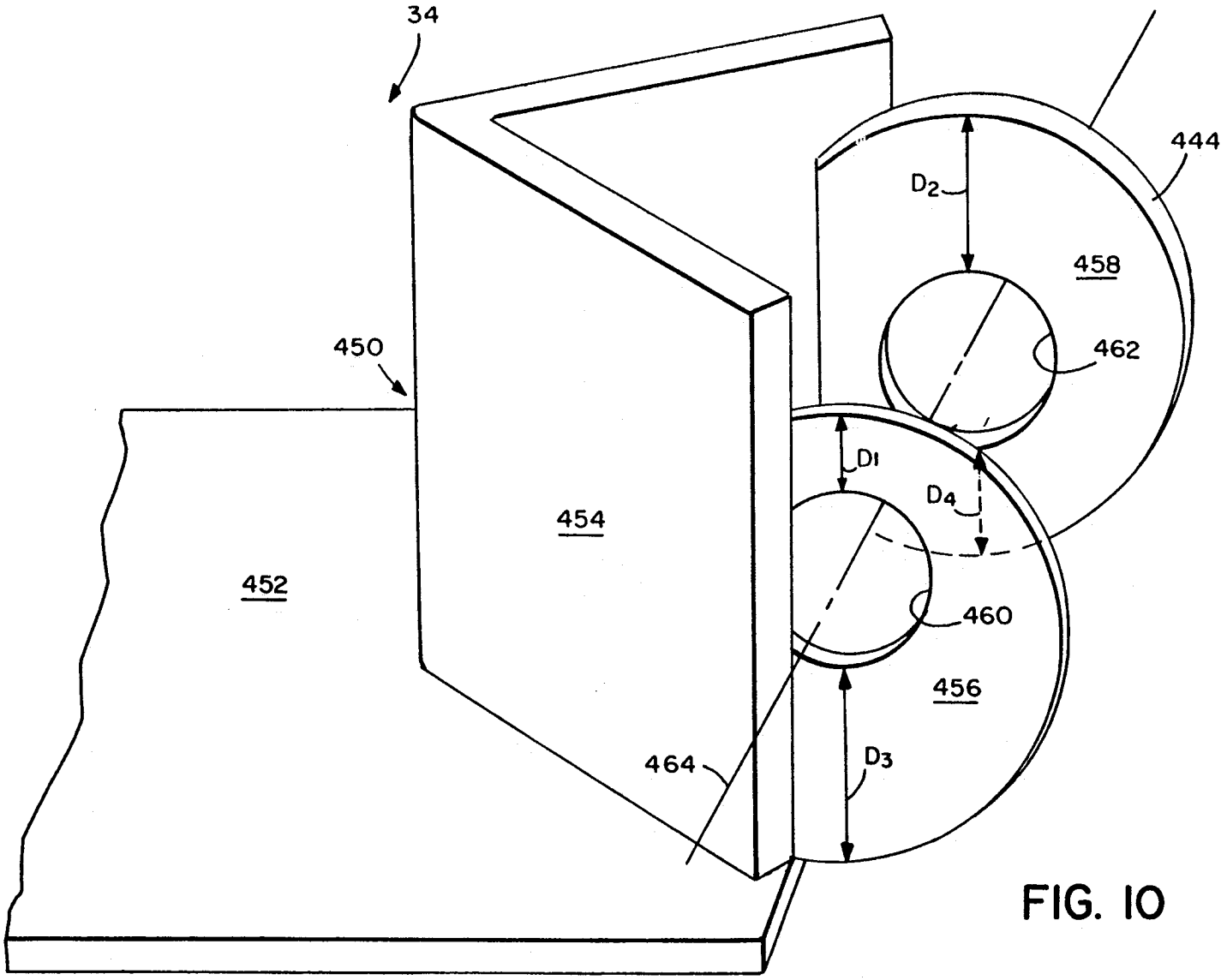
FIG. 10 is a perspective view of the article holder utilized with the article handling/supporting apparatus of this invention.

More specifically and as shown in FIGS. 1 and 10 article holder 34 includes a frame 450 preferably made of steel having a support plate 452, an upstanding wedge-shaped mounting plate 454 secured to plate 452 and a pair of cam-like extensions 456 and 458 secured to the inner surfaces of plate 454. The cam-like extensions 456 and 458 each have an opening 460 and 462, respectively, therein. The openings 460 and 462 are aligned coincidental with center line 464 and are sized slightly larger than pins 416 and 418 which are capable of protruding therethrough. As shown in FIG. 10 the outer portion of extensions 456 and 458 are of a cam-like configurations, that is, the distance $D_1$ is smaller than the distance $D_2$ while the distance $D_3$ is larger than the distance $D_4$. In other words, the outer surfaces 442 and 444 are eccentric about center line 464. The cam-like extensions 456 and 458 are configured in such a manner so as to enable slight adjustment of the position of article holder 34 with respect to the end 410 of main arm 28.

Stated more succinctly, once tool holder 34 is positioned upon holder support bar 42, the adjustment knobs can be tightened so that gripping surfaces 438 and 440 bear against cam-like surface 442 and 444, respectively. If a slight adjustment, either up or down, of article holder 34 is desired the operator merely sightly unscrews one of the adjustment knobs 430 or 432. By so doing the tool holder can be slightly rotated about support bar 412 until the loosened adjustment knob once again bear against the adjacent cam-like surface. The eccentric design of surfaces 442 and 444 prevents the tool holder 34 from completely rotating about bar 412. After slight rotation of tool holder 34 the cam-like surfaces 442 and 444 will once again bind against the gripping surfaces. After slight rotational adjustment has been made the operator once again tightens both the adjustment knobs 430 and 432 securely against cam-like surfaces 442 and 444. This arrangement permits slight adjustment of the relative position of article holder 34 without the possibility of article holder 34 rotating completely around bar 412.

MODE OF OPERATION

When an operator desires to use the article handling-/supporting apparatus 10 of the present invention, the operator merely has to wheel apparatus 10 to the desired location and connect apparatus 10 to an appropriate power supply. The article to be lifted or handled can be placed upon article holder 34 either prior to movement of apparatus 10 or after apparatus 10 is moved to its desired location. Once in position, wheel locking mechanisms 36 can be applied in order to prevent apparatus 10 from inadvertantly moving.

It is extremely easy for the operator to position a tool or work piece at its desired height and rotational position. Since the release buttons 402 are located near the end 410 of arm 28, the operator merely presses solenoid activation button 402 in order to simultaneously release the clamping mechanisms 210 and 324 as well as the turntable braking mechanism 105. By releasing mechanisms, 210, 324, and 105, the main boom 24 and main arm 28 are free to move in an up and down motion while the turntable assembly 14 is free to rotate 360 degrees. The operator is aided in the raising or lowering of main arm 28 and main boom 24 by the pair of spring loaded shock absorbers 32 and 300, respectively, in a manner described in greater detail hereinabove.

Once the article or workpiece is correctly positioned, button 402 can be released and simultaneously all solenoids 136 and 240 are disengaged. As a result thereof the main boom 24, the main arm 28 and the turntable 70 are locked in place. Slight adjustment of the position of turntable 70 can be accomplished by the rotation of adjustment knob 148 while slight adjustment of the height of main boom 24 and main arm 28 can be effected by the rotation of adjustment knobs 251, and 350, respectively, in the manner set forth in greater detail hereinabove with respect to the detailed description of these elements.

The lowering and removal of apparatus 10 is performed by the operator in the reverse manner described above.

It should be also noted that the handling/supporting apparatus 10 of this invention can also be used on a different support frame, such as, for example, the bed of a pick-up truck. If this type of use is desired, U-bolts 25 are removed and base plate 23 is mounted by any conventional securing device onto another frame or support (not shown). In the case of using apparatus 10 with a pickup truck, the power supply for activating solenoids 136 and 240 could be in the form of the 12-volt battery used with the vehicle.

Some specific uses for the invention include positioning and assembling of wood products in furniture factories, holding and positioning metal parts in steel fabricating and welding shops, holding and positioning items in heavy equipment repair shops and assisting "on the road" mechanics who repair equipment and need this device bolted to their service truck to help hold items being repaired.

It is clearly evident from the above description that the article handling/supporting apparatus 10 of this invention can be utilized in a number of ways and under a wide variety of circumstances. Although this invention has been described with reference to a particular embodiment, it is also capable of further and other embodiments within the spirit and scope of this invention.

What is claimed is:

1. An article handling/supporting apparatus, comprising:

a. a base;

b. a turnable assembly rotatably mounted upon said base said turntable assembly including means for securing said turntable assembly in a preselected rotational position with respect to said base, and means for slightly varying and preselected rotational position of said turntable assembly after said securing means has secured said turntable in said preselected rotational position;

c. a boom, said boom being pivotally mounted adjacent one end thereof to said turntable assembly, means for securing said boom in a preselected position with respect to said turntable assembly, and means for slightly varying said preselected position of said boom after said securing means has secured said boom in said preselected position;

d. an arm, said arm being pivotally mounted adjacent one end thereof to said boom, means for securing said arm in a preselected position with respect to said boom, and means for slightly varying said preselected position of said arm after said securing means has secured said arm in said preselected position;

e. means adjacent an end of said arm for attaching an article thereto; and f. means for simultaneously releasing said securing means associated with said turntable assembly, said boom and said arm.

2. An article handling/supporting apparatus, comprising:

a. a base;

b. a turntable assembly rotatably mounted upon said base, said turntable assembly including means for securing said turntable assembly in a preselected rotational position with respect to said base, and means for slightly varying said preselected rotational position of said turntable assembly after said securing means has secured said turntable in said preselected rotational position;

c. a boom, said boom being pivotally mounted adjacent one end thereof to said turntable assembly, means for securing said boom in a preselected position with respect to said turntable assembly, and means for slightly varying said preselected position of said boom after said securing means has secured said boom in said preselected position;

d. an arm, said arm being pivotally mounted adjacent one end thereof to said boom means for securing said arm in a preselected position with respect to said boom, and means for slightly varying said preselected position of said arm after said securing means has secured said arm in said preselected position.

e. means adjacent an end of said arm for attaching an article thereto; and f. means for simultaneously releasing said securing means associated with said turntable assembly, said boom and said arm, said means for simultaneously releasing said securing means associated with said turntable assembly, said boom and said arm including a plurality of solenoids;

g. said securing means associated with said turntable assembly, said boom and said arm includes means for normally biasing said securing means into the securing position.

3. An article handling/supporting apparatus as defined in claim 2 wherein said securing means associated with said arm includes a clamping device slideably mounted upon said arm and a support arm interconnected between said clamping device and said boom.

4. An article handling/supporting apparatus as defined in claim 3 wherein said securing means associated with said boom includes a clamping device and a two leg support tube interconnected between said boom and said turntable assembly, wherein said clamping device is fixedly secured to one leg of said support tube and is slideably mounted on the other leg of said support tube.

5. An article handling/supporting apparatus as defined in claim 4 wherein said means for slightly varying the position of said boom and said means for slightly varying the position of said arm each include a control rod which terminates in a fine adjustment control knob located proximate said end of said arm.

6. An article handling/supporting apparatus as defined in claim 5 which said means for simultaneously releasing said securing means associated with said turntable assembly, said boom and said arm includes at least one solenoid activation button located proximate said end of said arm.

7. An article handling/supporting apparatus as defined in claim 6 further comprising a first shock absorber interconnected between said boom and said turntable assembly and a second shock absorber interconnected between said arm and said boom.

8. An article handling/supporting apparatus as defined in claim 7 wherein said solenoids of said releasing means can be electrically connected to a 12 volt power supply.

9. An article handling/supporting apparatus as defined in claim 8 wherein said article attaching means includes means for adjusting the position of said article relative to said arm.

10. An article handling/supporting apparatus as defined in claim 9 further comprising said article, said article being in the form of a holding device having a pair of cam-like extension thereon for engaging said adjusting means of said attaching means.

11. An article handling/supporting apparatus as defined in claim 9 further comprising a frame secured to said base, said frame having means thereon for freely moving said frame to different locations, and means operably connected to said frame moving means of selectively preventing the movement thereof.

12. An article handling/supporting apparatus, comprising:

a. a base;

b. a turntable assembly rotatably mounted upon said base, said turntable assembly including a locking device for securing said turntable assembly in a preselected rotational position with respect to said base, and means for slightly varying said preselected rotational position of said turntable assembly after said securing means has secured said turntable in said preselected rotational position;

c. means pivotally secured to said turntable assembly for attaching an article thereto;

d. a locking device operably connected to said article attaching means for securing said article attaching means in a preselected position with respect to said turntable assembly;

e. means for slightly varying said preselected position of said article attaching means after said locking device has secured said article attaching means in said preselected position; and f. means for simultaneouosly releasing said locking device associated with said turntable and said article attaching means.

13. An article handling/supporting apparatus, comprising:

a. a base;

b. a turntable assembly rotatably mounted upon said base, said turnable assembly including a locking device for securing said turnable assembly in a preselected rotational position with respect to said base, said locking device including biasing means for biasing said locking device into the securing position and means for slightly varying said preselected rotational position of said turntable assembly after said securing means has secured said turntable in said preselected rotational position;

c. means pivotally secured to said turntable assembly for attaching an article thereto;

d. a locking device operably connected to said article attaching means for securing said article attaching means in a preselected position with respect to said turntable assembly;

e. means for slightly varying said preselected position of said article attaching means after said locking device has secured said article attaching means in said preselected position;

f. means including a pair of solenoids for simultaneously releasing said locking device associated with said turntable and said article attaching means; and g. a frame secured to said base, said frame having means thereon for freely moving said frame to different locations, and means operably connected to said frame moving means for selectively preventing the movement thereof.

14. An article handling/supporting apparatus as defined in claim 13 wherein said solenoids of said releasing means can be electrically connected to a 12-volt power supply.

15. An article handling/supporting apparatus as defined in claim 14 wherein said locking device connected to said article attaching means comprises a housing, a pari of arms pivotally connected to said housing, said biasing means being interposed between said arms forcing said arms into the locking position, and one of said solenoids being operably connected to said arms for moving said arm into a position releasing said locking device.

16. An article handling/supporting apparatus as defined in claim 15 wherein said turntable assembly comprises a turntable and said locking device associated with said turntable assembly includes a pair of braking member, means for connecting said braking members to said turntable, said biasing means being interposed between said braking members forcing said braking members into the locking position, and the other of said solenoids being operably connected to said braking members for moving said braking members into said position releasing said turntable.

17. An article handling/supporting apparatus, comprising:

a. base;

b. a turnable assembly rotatably mounted upon said base, said turntable assembly including means for securing said turntable assembly in a preselected rotational position with respect to said base, and means for slightly varying said preselected rotational position of said turntable assembly after said securing means has secured said turntable in said preselected rotational position;

c. a boom, said boom being pivotally mounted adjacent one end thereof to said turntable assembly, means for securing said boom in a preselected position with respect to said turnable assembly, and means for slightly varying said preselected position of said boom after said securing means has secured said boom in said preselected position;

d. an arm, said arm being pivotally mounted adjacent one end thereof to said boom, clamping means for securing said arm in a preselected position with respect to said boom, and means for slightly varying said preselected position of said arm after said securing means has secured said arm in said preselected position;

e. means adjacent an end of said arm for attaching an article thereto;

f. solenoid means associated with said securing means for each of said turntable assembly, said boom and said arm for releasing said securing means associated with said turntable assembly, said boom and said arm, and g. means for simultaneously activating all of said solenoid means.

* * * * *